US009297164B2

(12) United States Patent
Collins et al.

(10) Patent No.: US 9,297,164 B2
(45) Date of Patent: Mar. 29, 2016

(54) VIP ROOFING INSULATION

(71) Applicants: Richard O. Collins, Chadds Ford, PA (US); Dwight S. Musgrave, Granville, OH (US); Kenneth C. Areskog, Hoschton, GA (US)

(72) Inventors: Richard O. Collins, Chadds Ford, PA (US); Dwight S. Musgrave, Granville, OH (US); Kenneth C. Areskog, Hoschton, GA (US)

(73) Assignee: JROC Holdings, LLC, West Chester, PA (US)

( * ) Notice: Subject to any disclaimer, the term of this patent is extended or adjusted under 35 U.S.C. 154(b) by 0 days.

(21) Appl. No.: 14/476,947

(22) Filed: Sep. 4, 2014

(65) Prior Publication Data

US 2015/0059277 A1 Mar. 5, 2015

Related U.S. Application Data

(60) Provisional application No. 61/873,832, filed on Sep. 4, 2013.

(51) Int. Cl.
*E04D 3/35* (2006.01)
*E04D 13/16* (2006.01)
(Continued)

(52) U.S. Cl.
CPC ..... *E04D 13/1606* (2013.01); *E04D 3/351* (2013.01); *E04B 1/803* (2013.01); *E04D 3/32* (2013.01); *E04D 3/357* (2013.01); *Y10T 428/231* (2015.01)

(58) Field of Classification Search
CPC ..... E04D 3/351; E04D 3/32; E04D 3/357; E04D 3/35; E04D 1/28; E04D 12/00; E04D 12/004; E04D 13/1681
USPC ..... 52/409, 408, 411, 406.2, 407.3, 404.2, 52/404.4
See application file for complete search history.

(56) References Cited

U.S. PATENT DOCUMENTS 3,246,058 A * 4/1966 Voelker ..... 264/46.2
3,870,546 A * 3/1975 Gelsomino ..... 428/443
(Continued)

FOREIGN PATENT DOCUMENTS

| | | |
|---|---|---|
| CN | 201486072 | 5/2010 |
| DE | 102009054432 | 5/2011 |
| EP | 1213408 B1 | 5/2005 |
| WO | 2004001149 A2 | 12/2003 |
| WO | 2005068917 A1 | 7/2005 |
| WO | 2013025272 | 2/2013 |

OTHER PUBLICATIONS

Pär Johansson, Vacuum Insulation Panels in Buildings, Report in Building Physics, Göteborg, Sweden, Jan. 2012, From http://publications.lib.chalmers.se/records/fulltext/155961.pdf.
(Continued)

*Primary Examiner* — Phi A
(74) *Attorney, Agent, or Firm* — Stauffer Patent Services LLC; Moris Amon

(57) ABSTRACT

An insulating composite panel (ICP) 100, has an initial thermal resistance (R value) greater than about 50 $ft^2 \cdot {}^\circ F \cdot h/Btu$ (8.8 $K \cdot m^2/W$) at a thickness less than 2.0 in (51 mm). The ICP is preassembled with a vacuum insulation panel (VIP) 102 protected by a lower rigid cover board 104 adhered to a lower surface of the VIP by a lower grid of adhesive ribbons 108, and by an upper rigid cover board 106 adhered to an upper surface of the VIP by an upper grid of adhesive ribbons 110. Each of the adhesive grids 108, 110 is augmented by a respective continuous ribbon of adhesive 112, 114 along the entire perimeter of each respective interface between the VIP 102 and each respective cover board 104, 106. The ICP has high resistance to wind uplift, mold, and fire, and low mass per unit area.

19 Claims, 3 Drawing Sheets

(51) Int. Cl.
*E04D 3/32* (2006.01)
*E04B 1/80* (2006.01)

(56) References Cited

U.S. PATENT DOCUMENTS

| | | | | |
|---|---|---|---|---|
| 6,418,686 | B1 * | 7/2002 | Record | 52/309.15 |
| 2003/0082357 | A1 | 5/2003 | Gokay | |
| 2004/0148884 | A1 * | 8/2004 | Jacques et al. | 52/302.1 |
| 2009/0173037 | A1 | 7/2009 | Leo | |
| 2010/0170178 | A1 * | 7/2010 | Bennett et al. | 52/302.1 |
| 2011/0056148 | A1 * | 3/2011 | Jenkins et al. | 52/90.1 |
| 2012/0009376 | A1 | 1/2012 | Rusek | |
| 2012/0186633 | A1 * | 7/2012 | Carolan et al. | 136/251 |
| 2013/0029082 | A1 | 1/2013 | Park | |
| 2013/0216854 | A1 | 8/2013 | Feinerman | |
| 2014/0165487 | A1 * | 6/2014 | Mirmiran et al. | 52/408 |
| 2014/0260074 | A1 * | 9/2014 | Johnson et al. | 52/745.06 |

OTHER PUBLICATIONS

Microtherm, SlimVac vacuum insulation panels, web page http://www.microtherm.uk.com/low/EXEN/site/vip-intro.aspx, Sep. 27, 2013 (printed Oct. 17, 2014).

Nanopore, Vacuum Insulation Panels (VIPs), web page http://www.nanopore.com/vip.html, Sep. 27, 2013 (printed Oct. 17, 2014).

Panasonic, U-Vacua Vacuum Insulation Panel, web page http://www.panasonic.com/industrial/appliances-hvac-devices/vacuum-insulation/panel.aspx, Sep. 27, 2013 (printed 20-17-2014).

Porextherm, Vacupor, web page http://www.bau-vip.de/en/applications-bauvip/roof/vacuporr-vacuum-insulation-panels-for-flat-roof-insulation.html, Sep. 27, 2013 (printed Oct. 17, 2014).

UK Building Design Magazine, Vacuum Insulated Panels, From web page www.bdonline.co.uk/cpd-19/2013-vacuum-insulated-panels/5060517.article, Oct. 25, 2013.

* cited by examiner

VIP ROOFING INSULATION

CROSS-REFERENCE TO RELATED APPLICATIONS

This application claims the benefit of U.S. Provisional Patent Application No. 61/873,832, filed Sep. 4, 2013 by R. O. Collins, said application hereby incorporated in its entirety by reference herein.

TECHNICAL FIELD OF THE INVENTION

The present invention relates to the thermal insulation of building shells, and more particularly, to roof insulation based on vacuum insulation panels (VIPs).

BACKGROUND OF THE INVENTION

Since the 1970s, the cost of energy and the public awareness of the negative environmental effects of unrestrained energy consumption have increased worldwide. One of the largest components of humankind's total energy consumption is internal climate control—mainly, heating and cooling—of residential, commercial, and public buildings. An effective way to reduce this consumption is thermal insulation of building shells, such as exterior walls and roofs, since most of the energy used in controlling internal temperature compensates for the flow of heat from or into the building.

It is generally known that the best insulator against heat transfer by conduction and convection is vacuum. This concept has been put in practice in the form of the vacuum insulation panel (VIP) which typically comprises an evacuated, hermetically sealed, and approximately rectangular prismatic enclosure of low thickness/width and thickness/length ratios, having walls made of a high-barrier film or foil, and containing an internal rigid or semi-rigid core that keeps the walls from collapsing together under atmospheric pressure. The film is designed to keep diffusion of atmospheric gases, including water vapor, through it at an extremely low level, so that an effective internal vacuum can be maintained inside the VIP for many years. Thermal resistance (R value) equal to or greater than 50° F.·ft$^2$·h/Btu (degrees Fahrenheit—square foot—hour per Btu) has been achieved commercially.

Thermal resistance, designated as "R" or "R value", is a well-known quantity in the insulation industry. It typically pertains to heat transfer per unit area across the thickness of a planar or nearly planar insulating panel. As with electrical resistance, the thermal resistance (R value) of a stack of insulating panels equals the sum of the individual R values of the panels. The R value of a panel is defined as the ratio of the temperature difference ΔT (delta T) between the two sides of the panel to the steady-state heat flux Q/A:

$$R = \frac{\Delta T}{Q/A} = \frac{1}{U}$$

where Q is the total heat flow (in units of Btu/h or Watts, for example) through a planar area A (square feet or square meters, for example). Thermal resistance R is the reciprocal of another well-known quantity, the overall heat transfer coefficient U.

In the United States, the most commonly used unit of R is ° F.·ft$^2$·h/Btu. The conversion factor to the corresponding SI unit is:

$$0.1761\ (\mathrm{K{\cdot}m^2/W})/(^\circ\ \mathrm{F{\cdot}ft^2{\cdot}h/Btu})$$

Although VIP's have been used successfully in refrigerators and aerospace applications, they have not penetrated the building construction and remodeling market significantly. One reason has been that their gas barrier enclosure is easily torn or punctured during transport to, or installation at, a job site. The general concept of sandwiching the VIP between rigid protective boards to make what we call henceforth an "insulating composite panel" (ICP) has been proposed to address this problem. However, the prior art has not evidenced a practical implementation of the concept for use as an insulating component in roofing, where special fitness for use requirements must be met, for example:

1. fire resistance,
2. mold resistance,
3. light weight per unit area, and
4. wind uplift resistance.

Requirement 1 is a safety issue, usually legislated by building codes. Requirement 2 is a sanitary issue involving the growth of fungi generally known as mold and mildew. Requirement 3 meets builders' need for ease of hauling and assembling roofing elements on a high roof during construction. Requirement 4, which is also usually part of building codes, merits explanation.

Wind uplift is a well-known phenomenon in the roofing industry. It is a consequence of Bernoulli's law, which states that an inviscid (zero-viscosity or, in practice, low-viscosity) fluid moving simultaneously past two opposite surfaces of a solid body at different speeds generates a net pressure pushing the body towards the high-speed side. This is the principle behind the uplift on airplane wings. In the case of a roof, the air speed under it (inside the building) is essentially zero, but the air speed over it (outside the building) can be very high when there is a storm. Therefore, there can be a large pressure difference pulling roof components, including insulation panels, upwards, and in extreme cases, causing them to fly away. Combining Bernoulli's law with the ideal gas law, the formula approximately quantifying this pressure difference is obtained as:

$$v_{out}^2 - v_{in}^2 = \frac{2RT}{M}\ln\left(\frac{P_{in}}{P_{out}}\right)$$

where ν is the air velocity near the roof (m/s), R is the universal gas constant=8314 J/Kmol·K (Joules/Kilomole·deg Kelvin), T is the absolute temperature (degrees K), M=28.8 kg/Kmol is the average molar mass of air, P is absolute pressure (any unit), the subscripts "in" and "out" denote the side of the roof inside and outside the building, respectively, and ln is the natural logarithm. In most practical cases, $v_{in}$ is about 0, and $P_{in}$ is close to 1 atm=2117 lb$_f$/ft$^2$. With appropriate unit conversions, and setting T=10° C.=50° F.=283K, the following representative results are calculated:

| | | | | | | | |
|---|---|---|---|---|---|---|---|
| $v_{out}$ | mi/h | 0 | 108 | 153 | 188 | 218 | 245 |
| $P_{in}$-$P_{out}$ | lb$_f$/ft$^2$ | 0 | 30 | 60 | 90 | 120 | 150 |

Noting that $P_{out}$ is less than $P_{in}$ which is normal atmospheric pressure, the positive pressure difference $P_{in}-P_{out}$ is defined as the "wind uplift pressure". As can be seen, with wind gusts of 100-200 miles per hour (mi/h) typical of tornados or hurricanes, there can be substantial uplift force on the roof, at least for a few seconds.

The applicant's review of the prior art did not reveal references that fully address means or method for meeting important roofing requirements such as those listed above. A discussion of the prior art follows:

In a conference paper published in 2009, Musgrave describes an ICP consisting of a VIP sandwiched between two rigid "skins", with adhesive between skin and VIP on either side. (D. Musgrave, "Structural Vacuum Insulation Panels", International Vacuum Insulation Symposium, Session 2A, London, UK, 2009.) This paper focuses entirely on the thermal and structural advantages of such an ICP. This becomes apparent in the specific materials suggested for the skins, which consist of those mentioned in the following passage, quoted verbatim from the paper: "The skins can be almost any material such as steel, aluminum, or composites. If the skins are composite sheets, it can cover the full range of composites from common fiberglass reinforced polyester thermo-set resin to carbon fiber in an epoxy resin. Some extremely high grade composites are almost 3 times the modulus (stiffness) of steel."

In German patent application DE 10 2009 054 432 A1 (also published as EP 2,504,501) by Schröer et al., FIGS. 6 and 8 show an ICP consisting of a VIP sandwiched between upper and lower protective sheets. Although a variety of possible materials are casually mentioned for these sheets, their purpose beyond protecting the VIP from puncture or tearing is not considered. The patent application is focused on the method of attaching the ICP to rafters or a roof deck. This is achieved by means of screws or nails going through a "helper slat" ("hilfslattung" in German) interposed between adjacent VIPs and attached to the protective sheets. An obvious disadvantage is that non-VIP material, especially multiple panel-length strips such as these "helper slats" provide each panel with a significant proportion of area having a path of higher thermal conductivity through which heat flow can circumvent the VIPs.

In Chinese patent CN 201486072 assigned to Chengdu Somo Nanotechnology Co. LTD, as best as can be determined from the single drawing plus a rough machine translation, a VIP is shown encased completely in plaster, and described as having a total thickness of 15 mm. Allowing for a reasonable thickness for the VIP, this indicates that each of the two plaster layers covering the larger surfaces of the VIP is very thin and, therefore, fragile. Furthermore, plaster tends to absorb moisture and is vulnerable to mildew. It appears that the disclosed object is designed for use as a relatively small indoor ceiling tile.

In the international patent application publication W02005/068917 by Hake, the VIP (23) is totally encased in a hard-sided box or "cassette" (7) made of sheet metal, plastic, or wood. The box provides structural strength to the insulation portion (3) of a large self-supporting structural building component, and is shown being installed in cooperation with many different roofing elements. Hake's design approach is very specific to his objective of providing a large self-supporting structural building component suitable for installation on spaced-apart rafters. It can be seen that for installation on a flat roof, Hake's large, totally enclosed VIP component would be unnecessarily expensive, heavy and awkward to handle. Furthermore, the (vertical) cassette walls between adjacent VIPs obviously create a non-uniform R value over the roof as a whole, due to the low R value along every line of cassette walls.

The international patent application publication W02013/025272 by Castelle discloses a series of interlocking evacuated canisters—not panels—made of a malleable rigid material such as aluminum sheet. In many ways, Castelle's concept appears to be inappropriate for use as a roofing panel. For example, the materials may be inherently mold and fire resistant, but these metallic canisters are meant for insertion into hollow walls, and are not designed to resist wind uplift on a roof. For example, air gaps and metal walls between canisters would be vertical instead of horizontal when laid on a roof, thereby providing a low R value pattern due to convection as well as conduction.

In U.S. patent application U.S. 2003/0082357, Gokay et al. disclose a VIP design that includes heat-resistant sheets surrounding a vacuum supporting core structure such as a polymeric foam, which is heat-sensitive. The sheets and core are all inside the VIP membrane enclosure. Thus Gokay only discloses a VIP structure, not an insulated composite panel (ICP).

In European patent EP 1,213,406, Schnös describes a wall insulation system assembled at the construction site, comprising a VIP propped against a pre-existing vertical wall, supported by wall-mounted channel-shaped profiles on its four thin sides, and covered on its remaining large side by a cover panel of gypsum board, expanded polystyrene, or wood, attached to the profiles. There is only one cover board, and the VIP is not adhered to it or to the wall. It is unlikely that the wind uplift requirement would be met if this system were installed on a sloped or flat roof.

Given the obvious limitations and inadequacy of the above-described prior art, all of which relates to aspects of an ICP incorporating a VIP, it is an objective of the present invention to devise an ICP design that fully addresses roofing requirements such as the four listed above.

Beyond meeting minimum requirements, it is an objective to determine specifics of a premium insulated roofing system of materials and method sufficient to produce a finished roof with a very high R value but minimized thickness, and having durability for a long effective life.

Even further, it is an objective to simplify and minimize the cost of the ICPs and their installation, while maximizing the R value uniformity and coverage of the roof.

BRIEF SUMMARY OF THE INVENTION

The present disclosure describes what is termed herein as an "insulating composite panel" (ICP), having an initial thermal resistance (R value) greater than about 50 $ft^2 \cdot {}^\circ F \cdot h/Btu$ (8.8 $K \cdot m^2/W$) at a thickness less than 2.0 in (51 mm), comprising a vacuum insulation panel (VIP), a lower rigid cover board adhered to a lower surface of the VIP by means of a lower grid of adhesive ribbons, and an upper rigid cover board adhered to an upper surface of the VIP by means of an upper grid of adhesive ribbons. Each of the adhesive grids are preferably augmented by a continuous ribbon of adhesive along the entire perimeter of the interface between VIP and cover board. An inventive selection of materials and assembly methods for the invention are described and examples given that have been found to be suitable for obtaining a novel ICP that has high resistance to wind uplift, mold, and fire, and low mass per unit area, as specified in the objectives.

Other objects, features and advantages of the invention will become apparent in light of the following description thereof.

BRIEF DESCRIPTION OF THE DRAWINGS

Reference will be made in detail to preferred embodiments of the invention, examples of which are illustrated in the accompanying drawing figures. The figures are intended to be illustrative, not limiting. Although the invention is generally described in the context of these preferred embodiments, it should be understood that it is not intended to limit the spirit and scope of the invention to these particular embodiments.

Certain elements in selected drawings may be illustrated not-to-scale for clarity. In particular, adhesive ribbons and layers are shown thicker than they really are.

Figure 1:
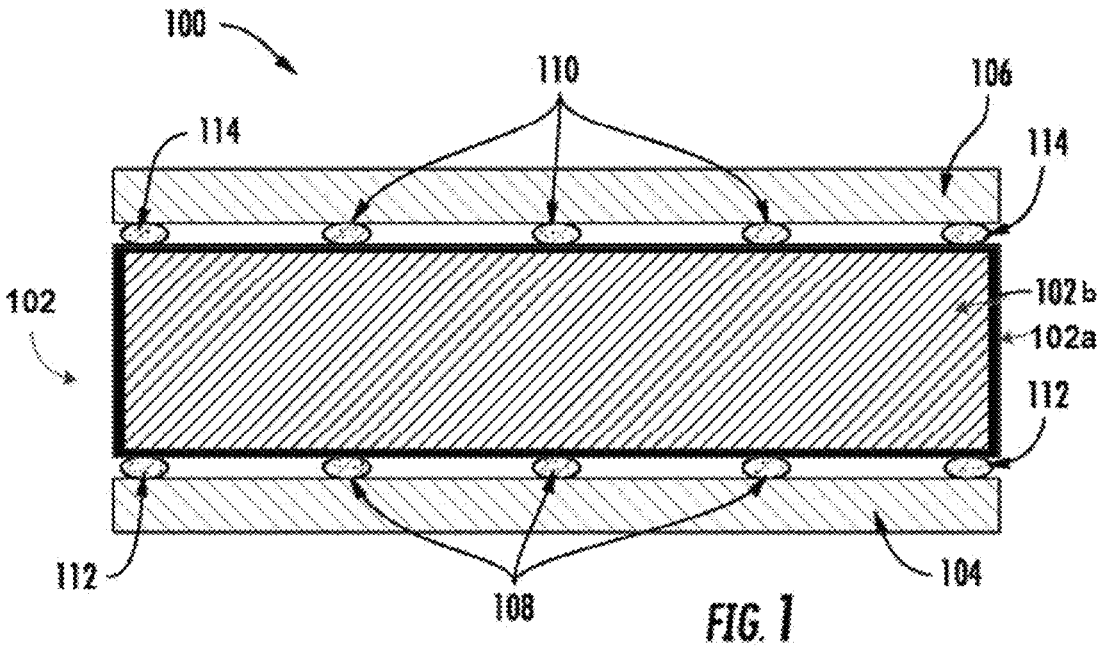
Figure 2:
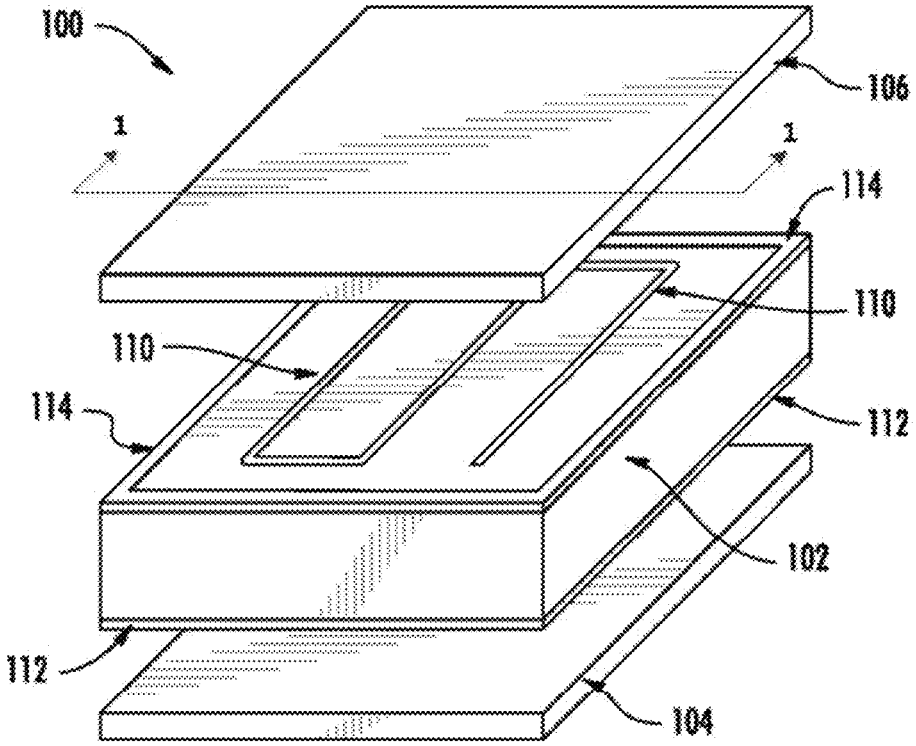

The structure, operation, and advantages of the present preferred embodiment of the invention will become further apparent upon consideration of the following description taken in conjunction with the accompanying drawings, wherein:

FIG. 1 is a cross section of the assembled ICP, perpendicular to its principal plane, viewed as shown by the cross section indicator 1-1 in FIG. 2, all according to the invention.

FIG. 2 is an exploded 3-dimensional view of the ICP, showing the configuration of the adhesive ribbons, according to the invention.

Figure 3:
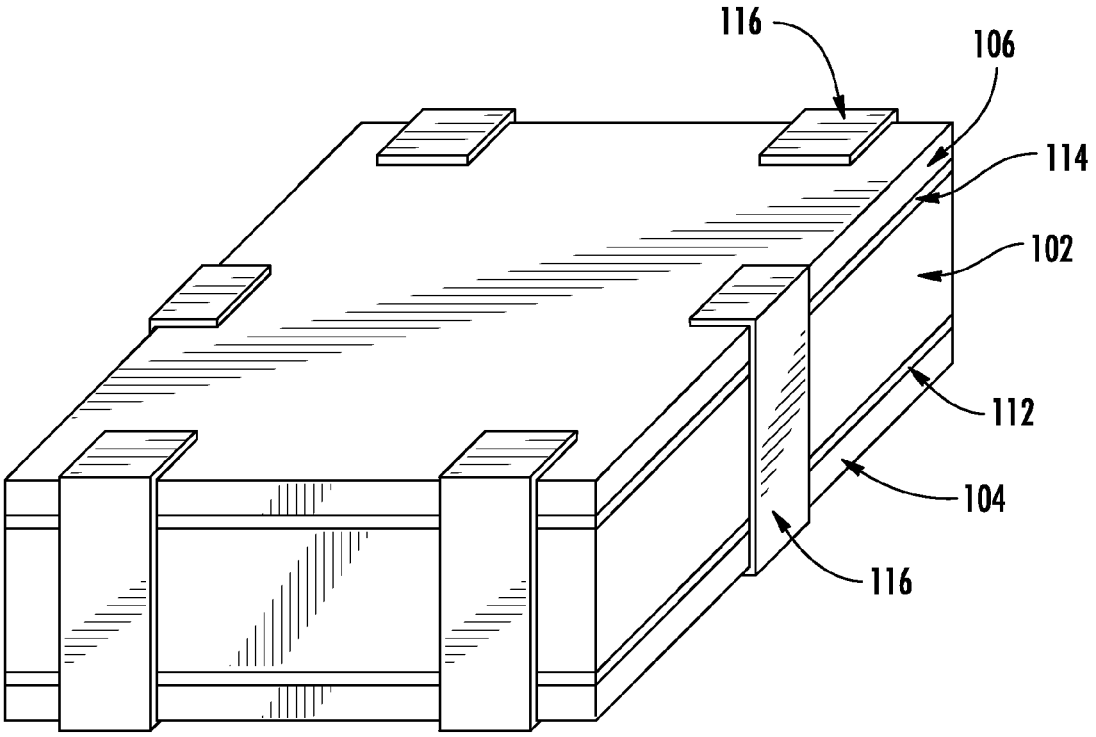

FIG. 3 is a 3-dimensional view of the assembled ICP, showing, in addition to the elements already shown in FIG. 1, clamps that help to hold the cover boards and VIP together against wind uplift, according to the invention.

Figure 4:
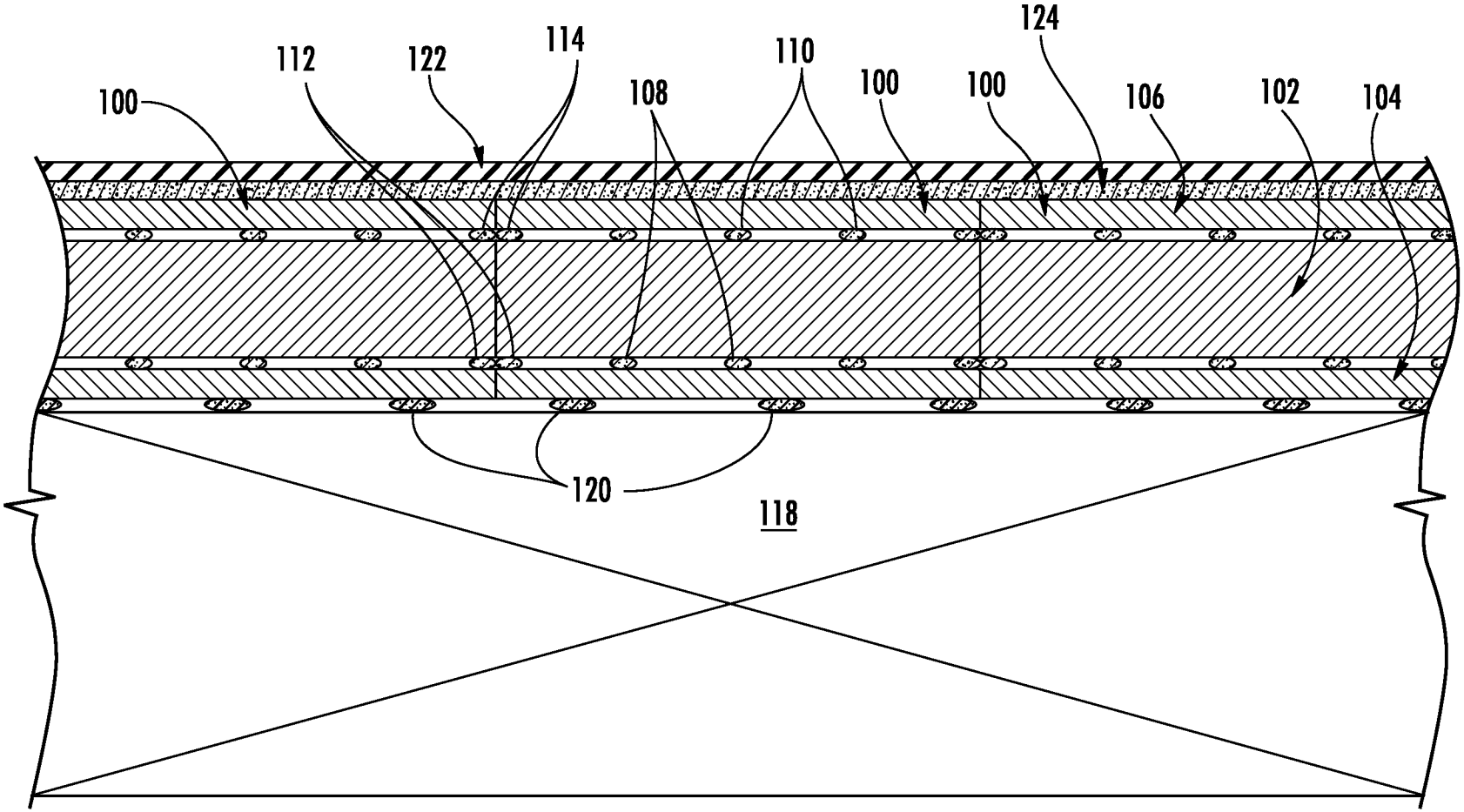

FIG. 4 is a cross-section of a completed installation of a low-slope roof incorporating several ICPs of Figure, installed according to the invention on a roof deck (internal structure omitted), covered by a roofing membrane, and with adhesives joining the ICP to the deck and membrane.

Elements are numbered such that the same elements are referred to with the same numbers in all drawing. These numbers are used throughout the specification, including the claims and abstract, and are tabulated as follows.

| Number | Description |
|---|---|
| 100 | Insulating composite panel (ICP) |
| 102 | Vacuum insulation panel (VIP) |
| 104 | Lower rigid cover board |
| 106 | Upper rigid cover board |
| 108 | Lower adhesive grid |
| 110 | Upper adhesive grid |
| 112 | Lower perimeter adhesive ribbon |
| 114 | Upper perimeter adhesive ribbon |
| 116 | Clamp |
| 118 | Roof deck (continuous) |
| 120 | Deck-to-ICP adhesive grid |
| 122 | Roofing membrane |
| 124 | ICP-to-membrane adhesive |

DETAILED DESCRIPTION OF THE INVENTION

In line with the stated objectives, the applicant first determined a list of four roofing requirements that are critically important when designing our novel insulated roofing system:

1. fire resistance,
2. mold resistance,
3. light weight per unit area, and
4. wind uplift resistance.

Secondly the applicant determined lower limits for the physical properties specified by the requirements, with a particular focus on properties suitable for a premium insulating roofing system.

Finally the applicant studied materials to determine criteria for selection of materials and methods that will meet the identified properties, the materials and methods being:

- materials for ICP components, especially the protective boards,
- materials and method used in assembling the ICP, and
- materials and method used for installing the ICPs as part of a complete insulated roof.

The inventive ICP comprises three key elements:

1. A previously manufactured vacuum insulation panel (VIP).
2. Two rigid cover boards against the two large faces of the VIP.
3. An adhesive applied in the form of elongated ribbons between the VIP and each board.

Each of these elements will be discussed in detail in the following subsections.

Vacuum Insulation Panel

The central component of the inventive ICP 100 is the VIP 102, which typically comprises 1) an external evacuated, hermetically sealed, and approximately rectangular prismatic enclosure 102*a* of low thickness/width and thickness/length ratios, having walls made of a high-barrier laminate, and 2) an internal rigid or semi-rigid core 102*b* that keeps opposite enclosure walls from collapsing and contacting each other under atmospheric pressure.

The laminate making up the enclosure walls is designed to keep diffusion of atmospheric gases, including water vapor, through it at an extremely low level, so that an effective internal vacuum can be maintained inside the VIP for 20 or more years. The laminated layers could be films of polyesters, polyolefins, polyamides, barrier polymers (PVdC, EVOH), etc., or woven or nonwoven fabrics, including those made of synthetic fibers such as polypropylene, Nylon® or Kevlar®. However, the gas barrier levels of even the best known polymeric films are far from sufficient to maintain a low enough gas pressure inside the VIP over the desired life time of 20 or more years. Hence, practical laminates include inorganic layers to achieve the required high barrier level. Examples are prefabricated aluminum foil, sub-micron aluminum layers deposited by physical vapor deposition (PVD) under vacuum, and aluminum or silicon oxide layers deposited by sputtering or chemical vapor deposition (CVD) under vacuum. While aluminum foil is practically impermeable to gases when intact, its gas barrier is quickly impaired by creasing or repeated bending, which creates micro-cracks. Vacuum-deposited organic layers are more flexible but contain microscopic defects, such as pinholes, from the start. Depositing two or more inorganic layers separated by thin (of the order of a few μm) polymeric layers insures that the defects in successive inorganic layers are unaligned and that a gas molecule that leaks through a pinhole in one inorganic layer has to travel a long path, approximately parallel to the layer planes, through polymer before it finds a pinhole in the next inorganic layer. In effect, the long, tortuous path through polymer required for gas diffusion provides the desired barrier.

The core of the VIP could comprise one or more each of a rigid polymeric foam, a flexible foam reinforced by rigid supports, a light metal honeycomb structure, a powder, or a fibrous mat of fiber glass or other synthetic or natural fibers.

In one example of the VIP 102 used in a preferred embodiment of the present invention, the barrier film is a lamination incorporating two or more layers of vacuum-deposited aluminum, and the core is a mat of entangled glass fibers generally oriented parallel to the largest face of the prismatic enclosure. In addition to greatly reducing heat transfer by convection and conduction, this design minimizes radiative heat transfer by scattering and reflection, so that overall, a remarkable R value of 50 $ft^2 \cdot {}^\circ F \cdot h/Btu$ (8.8 $K \cdot m^2/W$) is achieved at approximately 1 inch (25 mm) thickness. This product has been commercialized under the name THRESHHOLD™ by Thermal Visions Inc. of Newark, Ohio.

Cover Boards

The most obvious function of the cover boards 104, 106 is to protect the VIP from external impacts or highly localized pressures including, for example: falling objects (e.g. tree branches), hail, installation or maintenance personnel (e.g. walking or kneeling), installation or maintenance equipment (e.g. tool carts), and imperfections that are slightly raised above the mounting surface of a roof deck 118 (e.g., raised nail head). Therefore mechanical properties such as flexural modulus, flexural strength, and impact strength are important. However, for the purposes of the present application, we focus on the four requirements listed hereinabove since they most-distinguish this invention from the prior art.

A variety of material classes can potentially be used to make the cover boards 104, 106 of the inventive ICP 100, including wood, metals, gypsum board, and rigid polymeric foams, for example. The latter two categories are discussed as follows.

Gypsum Board:

Gypsum board suitable for roofing applications is made from raw gypsum, calcium sulfate dihydrate, $CaSO_4 \cdot 2\ H_2O$, mined or obtained from flue gas desulfurization, then calcined to the hemihydrate $CaSO_4 \cdot ½\ H_2O$. The resulting plaster is mixed with cellulosic or glass fibers and other additives and dried in a large drying chamber. Optionally, the calcined gypsum may be contained between adhering sheets of heavy paper or mats of fiberglass called facers.

An example of gypsum board particularly suitable for the purposes of the present invention is Securock®, made by Carlisle SynTec Systems of Carlisle, Pa. According to the manufacturer's data sheet dated Jan. 7, 2014, this fiber-reinforced, facerless board has a number of useful properties in view of the four requirements stated hereinabove, properties such as:

- Excellent fire performance and exceptional surface burning characteristics per ASTM test E84: Flame Spread 5, Smoke Developed 0.
- Mold resistance of 10—the highest possible rating—per ASTM test 3273.
- Enhanced adhesion to other surfaces due to the absence of a fiber-glass facer—which contributes to increased wind uplift resistance.

Securock's disadvantage, like all gypsum boards, is that it weighs 1.43 lb/ft$^2$ (6.98 kg/m$^2$) at ¼" (7 mm) nominal thickness, which is rather heavy. Moreover, at ¼" thickness, its R value is only 0.2 ft$^2$·° F.·h/Btu (0.035 K·m$^2$/W), which, even after multiplication by 2, is a negligible addition to a VIP's R.

Polymeric Foams:

Rigid polymeric foams can be classified as blown and syntactic. The cells in blown foams are gas bubbles created by the gas-generating decomposition of a chemical blowing agent, the evaporation of a physical blowing agent, or a step in a polymerization reaction that produces one or more gases as a byproduct. In contrast, the cells in a syntactic foam are obtained by mixing a multitude of small hollow objects, such as hollow glass spheres of diameters ranging 5-100 μm, into a matrix material, as or before it is polymerized. Foams can further be classified as open- or closed-cell. In open-cell foams, most of the cells are connected to neighboring cells to form a semi-continuous gas phase within the polymeric matrix. In closed-cell foams, the cells are discrete and unconnected. Open-cell foams can have lower density (translating to lower weight per unit area), but closed-cell foams are generally preferred for roofing applications because of their superior mechanical and fire resistance properties.

Of particular interest as a material for the cover boards is the class of polyurethane (PUR) foams in general and polyisocyanurate (PIR) foams in particular. Polyurethane foams are produced by the condensation polymerization of a polyisocyanate and a polyol plus water to generate carbon dioxide. Chemical and physical blowing agents may be added to produce more gas. The term "polyurethane" is chemically inaccurate in that not all linkages in the final product are urethane linkages —NH—COO—, but it is in widespread industrial usage and generally accepted. In the case of PIR, the monomers are methylene diphenyl diisocyanate (or n-n'-diphenylmethane di-isocyanate, where n=2 or 4), also known as MDI, and a polyester-derived polyol. The polyol has more than two functional groups per molecule to obtain a controllable degree of cross-linking. The chemistry of PUR and PIR foams is a complex and extensive topic, and the present short discussion is meant only to outline a field of interest and not to restrict the possible embodiments of the invention within this field.

A particular example of PIR foam board used in a preferred embodiment of the present invention is Invinsa® FR made by the Johns Manville Corporation of Denver, Colo. This product has a number of useful properties in view of the requirements stated hereinabove:

- It provides Class A fire resistance per Underwriter Laboratories standard UL790, even when mounted on a wood deck, according to the manufacturer's technical data sheet RS-5553 4-14.
- A mold resistance test commissioned by the applicant and executed by MicroStarLab of Crystal Lake, Ill. according to the ASTM D3273 test procedure resulted in the highest possible rating of 10. That is, there was no mold at all on any Invinsa board face after 4 weeks of exposure to certain mold spores at elevated temperature (32.5±1° C.) and relative humidity (95%). Control samples of generic wall board were almost entirely covered in mold, for a rating of 0 to 1, as expected, demonstrating the validity of the test.
- It weighs only 0.406 lb/ft$^2$ (1.96 kg/m$^2$) at ¼ in (7 mm) nominal thickness. This is less than ⅓ the weight of gypsum board of the same thickness.

The R value of Invinsa FR at ¼ in thickness is 1.2 h·ft$^2$·° F./Btu (0.21 m$^2$·K/W). When multiplied by 2, this is a modest but not negligible addition to the R value of a VIP.

VIP-Cover Board Adhesive

Nails and screws would either puncture or risk puncturing the VIP and therefore should not be used to assemble it with the cover boards. A preferred alternative is to use adhesives. There are many suitable adhesives, and covering all the possibilities is beyond the scope of this application. Instead, three statements of principle will be made about the mode of application and nature of the adhesive, and an example will be provided.

First, unmatched slight deviations from perfect flatness in the VIP 102 and cover board 104 or 106 surfaces may cause these surfaces to lie farther from each other in some areas when the VIP and a cover board are put together. Therefore, the adhesive must be thick enough to reliably bridge such gaps and contact both of the surfaces it is intended to join. The applicant has determined that typically, an adhesive thickness of 4-8 mm is prudent. However, it would be difficult and expensive to cover both large surfaces of the VIP with a continuous layer of adhesive of such thickness. A practical solution is to apply ribbons of adhesive 108, 110 in a grid pattern. The term "grid" may mean approximately parallel ribbons at approximately regular spacing, as in 108 or 110 in FIG. 2. The typical spacing ranges from 4 to 8 inches (10 to 20 cm) from the center of one ribbon to the next. Alternatively, a "grid" may be any approximately regular pattern of multiple intersecting lines, including a rectangular pattern. The grid-patterned adhesive application may be performed by a glue gun, nozzle or similar device for dispensing a ribbon of adhesive. The operation may be manual or automated.

Secondly, to obtain the maximum wind uplift resistance it is important to prevent the possibility of a separation action between the cover board 104 or 106 and VIP 102. The applicant's testing showed that such separation action is initiated or caused at the perimeter (i.e. the outer edge) of their interface. The applicant experimentally determined an effective way to increase wind uplift resistance for the ICP assembly by applying a continuous ribbon of adhesive all around the perimeter of at least one or preferably both of the VIP-cover board interfaces. This is designated by the numbers 112 and 114 in FIG. 2.

Thirdly, the softening temperature of the adhesive must be safely above the highest roof temperatures likely to be encountered. This softening temperature may be the glass transition temperature, the melting point if the adhesive is semi-crystalline, or a functionally defined temperature at which the adhesive loses its minimum acceptable cohesive strength.

One class of adhesives which may satisfy the foregoing requirements is two-component adhesives, where two viscous liquid chemicals are stored in separate compartments of the dispenser. These two components are combined in a single stream just as they come out of the dispenser's nozzle. Thereafter, they react with each other to form a polymerized, cross-linked, hardened ribbon. The reaction is slow enough (of the order of 1 to several minutes for complete conversion) to allow formation of the adhesive grid on one surface of the interfacing components (VIP or cover board), followed by placement and adhesion of the other component under gentle pressure.

Alternatively, solvent-based adhesives, which harden permanently once their solvent constituent diffuses out and evaporates, may be used. However, such adhesives often present environmental and health problems because of the amount of toxic solvents released into the ambient atmosphere. This becomes an acute problem if the VIPs and cover boards are assembled in an enclosed space such as a factory building.

Another alternative, which solves the last problem, is to use hot melt adhesives. These are heated to well above their softening temperature in the dispenser. Once they are applied as a thick ribbon to one interfacing component, they cool slowly because of their low thermal conductivity. This allows time to place and adhere the other component. Preferably, to avoid thermally induced damage or localized shrinkage of the VIP's barrier film, the adhesive is first applied to a cover board before it is gently pressed against the VIP, after which the adhesive hardens below its softening point, where it remains at all likely storage or roof exposure temperatures.

A particular example of a hot melt adhesive used in a preferred embodiment of the present invention is GIA1060-APAO Polyolefin Hot Melt Adhesive made by the Glue Machinery Corporation of Baltimore, Md. According to the manufacturer's data sheet, its recommended application temperature is 340 to 375° F. (171 to 191° C.) and its softening point is 258° F. (126° C.).

Wind Uplift Resistance

In a preferred embodiment of the present invention, two Invinsa FR boards, one THRESHHOLD® R-50 vacuum insulation panel, and the GIA1060—APAO Polyolefin Hot Melt Adhesive, all described in the preceding subsections, were combined to assemble a particularly advantageous ICP as shown in FIGS. 1 and 2. The test ICP had dimensions of 24×24×1.5 inches (610×610×38 mm). The 1.5" thickness was made up of 1" for the VIP and ¼" for each of the cover boards. The adhesive did not contribute significantly to thickness once compressed.

A wind uplift resistance test was commissioned by the applicant and executed by PRI Construction Material Technologies of Tampa, Fla. according to ANSI/FM 4474 Appendix B: Simulated Wind Uplift Pull Test Procedure. It was found that the failure pressure was between 180 and 195 $lb_f/ft^2$ (8.6 to 9.3 KPa). ANSI suggests optionally dividing the lower bound by 0.85 then rounding down to the nearest multiple of 15 $lb_f/ft^2$, to allow conservatively for various typical factors that arise commonly in flat roof applications. By that approach, the failure pressure is about 210 $lb_f/ft^2$ (10.0 KPa). In either case, this is well above the minimum standard of 60 $lb_f/ft^2$ (2.9 KPa) accepted in the U.S. roofing industry, and corresponds to roof-surface wind speeds well over 200 mi/h (322 Km/h) as seen from the table in the Background section. This helps our claim to a premium roofing system.

In a second test commissioned by the applicant at the same laboratory, six steel 3 inch-wide (7.5 cm) U-shaped fitted clamps 116 were incorporated in the ICP to reinforce the bond between VIP and cover boards, as shown in FIG. 3. The clamps contained no screws or moving parts, but were dimensioned to fit snugly over the edges of the ICP. The clamp surfaces were approximately flush with the remaining surfaces of the ICP because they squeezed the foam cover boards 104, 106 slightly and locally. With this additional improvement, the failure pressure went up to between 240 and 255 $lb_f/ft^2$ (11.5 to 12.2 KPa).

Roof Construction

The applicant estimates that, at least in the near future, the inventive ICP is likely to be used primarily on low-slope roofs. High-slope roofs could become a large commercial market in the future, but are unlikely to be so now because 1) ample attic space under high-slope roofs reduces the need for thin insulation, and 2) presently available roof tiles have to be nailed down over the ICP, which could damage the VIP.

Although an ICP could be assembled at a roof construction site, the inventive ICP is preassembled at an off-site facility, for example in a centralized factory. The applicant has identified many reasons for preassembly, particularly for a premium product. Importantly, ICP quality, life, and uniformity of properties can be severely degraded when the components are separately shipped to a construction site where they will be stored and assembled in an uncontrolled environment allowing moisture dust and debris to accumulate on component surfaces where they can interfere with adhesive bonding and/or trap moisture between components where it can support mold growth, degrade performance and damage materials as the water attempts to escape. Dust and debris on an unprotected VIP membrane is a source of pinhole leaks or outright punctures. If the ICP components are assembled while they are layered on a roof, then the VIP will be very vulnerable to damage from contractors and equipment before the protective top cover board is applied. Of course a factory supplying preassembled ICPs to numerous construction sites has the economies of scale that can justify investment in automated or semi-automated machinery. If the manufacture of the VIP from its raw materials is integrated with the assembly of the ICP, then the economies of scale are even bigger. Factory assembly provides opportunities to minimize labor cost, increase production speed, and improve quality control and quality assurance. The remaining discussion will thus assume that the ICP is a manufactured unit comprising a VIP, two cover boards, and adhesive(s), each as described above, plus possible ancillary elements.

Referring to FIG. 4, a low-slope or flat roof incorporating the inventive ICP may be constructed as follows: The foundational roof deck 118 should preferably be a continuous, rigid, and essentially planar surface. This ensures that the ICPs are fully supported and bear only compressive but not bending loads. The deck may be made of wood, galvanized steel, concrete or other materials. Wood and combustible materials are less preferred from a fire resistance point of view. The deck surface is cleaned to remove dust and debris. The lower face of the ICP may be bonded to the deck by applying an adhesive 120 in a pattern similar to the grid of ribbons used for bonding the internal components of the ICP to one another, as described previously. A suitable adhesive is OlyBond 500 Green, manufactured by OMG Roofing Products, Inc. of Agawam, Mass. This is a two-component, solventless, water-blown polyurethane foam adhesive. (See discussions of polyurethanes and polymeric foams above). After all the ICPs are installed side by side with no gaps between them, they are covered by a roofing membrane 122, which is the principal barrier against the ingress of water. One complete ICP 100 and parts of two adjoining ones, all covered by the same membrane 122 are shown in FIG. 4. The membrane may be made of high-reflectivity polyvinyl chloride (PVC), ethylene-propylene-diene monomer (EPDM) rubber, a thermoplastic polyolefin (TPO), modified bitumen (MB) or other water-impermeable material. A suitable adhesive 124, as recommended by the membrane manufacturer, is coated on the entire top surface of the ICPs by brush or roller in order to fully adhere the membrane, which is flexible enough to conform to uneven surfaces. The details of membrane technology are beyond the scope of the present application.

One of the advantages of the inventive ICP, especially in its preferred embodiment described above, is its minimal thickness combined with its exceptionally high R value. The calculated R of the pre-assembled ICP preferred embodiment is at least 50, for example about 52 $ft^{2\cdot}$° F.·h/Btu (9.2 $K\cdot m^2/W$), at a thickness of only about 1.5 in (38 mm). To achieve the same R with traditional insulation materials, the insulation would need to be about 10 times thicker—that is, about 15 in (380 mm) thick. If this very thick insulation is retrofitted on an existing low-slope roof over a concrete deck, the extra thickness could require costly adaptations. For example, existing counter-flashing at the junctions of the roof with vertical surfaces such as chimneys, adjoining building walls, penthouse walls, etc. may have to be torn out and replaced; or utility pads, parapets, or the sills of windows looking out on the roof may have to be raised. Moreover, the labor and energy to transport the extra volume of material to the construction site and then up to the roof could be significant. Alternatively, if the building owners accept a lower R, they will incur significant extra financial cost due to higher energy expenses. The socialized cost of the pollution due to the higher energy consumption is even larger.

Although the invention has been illustrated and described in detail in the drawings and foregoing description, the same is to be considered as illustrative and not restrictive in character—it being understood that the embodiments shown and described have been selected as representative examples including presently preferred embodiments plus others indicative of the nature of changes and modifications that come within the spirit of the invention(s) being disclosed and within the scope of invention(s) as claimed in this and any other applications that incorporate relevant portions of the present disclosure for support of those claims. Undoubtedly, other variations based on the teachings set forth herein will occur to one having ordinary skill in the art to which the present invention most nearly pertains, and such variations are intended to be within the scope of the present disclosure and of any claims to invention supported by said disclosure.

What is claimed is:

1. An insulating composite panel (ICP) for use on building roofs, comprising:

a prefabricated assembly having a thickness less than 3.0 inches (76 mm) and an initial thermal resistance (R value) greater than 30 degrees Fahrenheit-square foot-hour per Btu (30° F.·$ft^2$·h/Btu) (5.3 $K\cdot m^2/W$), wherein the prefabricated assembly includes:

a vacuum insulation panel (VIP) comprising:

a) a substantially evacuated and hermetically sealed enclosure, with walls made of a high gas barrier material, in an approximately rectangular prismatic shape with low thickness/width and thickness/length ratios, and b) an internal rigid or semi-rigid core for keeping enclosure walls from collapsing while evacuated;

a lower rigid cover board adhered to a lower surface of the VIP, and an upper rigid cover board adhered to an upper surface of the VIP;

and wherein:

the prefabricated assembly is adapted for maintaining its integrity at a wind uplift pressure of at least 120 pounds-force per square foot (5.75 KPa) according to ANSI/FM 4474 Appendix B: Simulated Wind Uplift Pull Test Procedure, by means comprising a continuous ribbon of adhesive along the entire length-width perimeter of each of the two interfaces between VIP and rigid cover board.

2. The ICP of claim 1, wherein the prefabricated assembly has a thickness less than 2.0 inches (51 mm) and an initial R value greater than about 50° F.·$ft^2$·h/Btu (8.8 $K\cdot m^2/W$).

3. The ICP of claim 1, wherein:

the prefabricated assembly is further adapted for maintaining its integrity at a wind uplift pressure of at least 120 pounds-force per square foot (5.75 KPa) according to ANSI/FM Appendix B: Simulated Wind Uplift Pull test Procedure, by means comprising a grid of adhesive ribbons at each of the two interfaces between VIP and rigid cover board.

4. The ICP of claim 1, wherein the adhesive is a hot melt adhesive.

5. The ICP of claim 1, wherein at least one of the rigid cover boards is selected for physical properties including no less than a Class A fire resistance as defined by Underwriter Laboratories standard UL790.

6. The ICP of claim 1, wherein at least one of the rigid cover boards is selected for physical properties including a mold resistance rating no less than 10 according to ASTM test method D3273.

7. The ICP of claim 1, wherein the prefabricated assembly has a mass per unit area of less than 3.0 pounds per square foot (14.7 $kg/m^2$).

8. The ICP of claim 1, wherein one or both of the rigid cover boards comprise more than 50% by mass of a polymer.

9. The ICP of claim 8, wherein the polymer belongs to the class of polyurethanes.

10. The ICP of claim 8, wherein the polymer is polyisocyanurate (PIR).

11. The ICP of claim 8, wherein the polymer is in the form of a closed-cell foam.

12. The ICP of claim 11, wherein both of the rigid cover boards have a bulk density between about 12 and 31 pounds per cubic foot (between about 200 and 500 $kg/m^3$).

13. The ICP of claim 1, wherein one or both of the rigid cover boards comprise more than 50% by volume of gypsum.

14. The ICP of claim 13, wherein the gypsum is reinforced by one or more types of fibrous material.

15. An insulating composite panel (ICP) for use on building roofs, comprising:

a prefabricated assembly having a thickness less than 3.0 inches (76 mm) and an initial thermal resistance (R value) greater than 30 degrees Fahrenheit-square foot-hour per Btu (30° F.·ft$^2$·h/Btu) (5.3 K·m$^2$/W), wherein the prefabricated assembly includes:

a vacuum insulation panel (VIP) comprising:

a) a substantially evacuated and hermetically sealed enclosure with walls made of a high gas barrier material in an approximately rectangular prismatic shape with low thickness/width and thickness/length ratios, and b) an internal rigid or semi-rigid core for keeping enclosure walls from collapsing while evacuated;

a lower rigid cover board adhered to a lower surface of the VIP, and an upper rigid cover board adhered to an upper surface of the VIP;

and wherein:

the prefabricated assembly is adapted for maintaining its integrity at a wind uplift pressure of about 180 pounds-force per square foot (8.6 KPa) according to ANSI/FM 4474 Appendix B: Simulated Wind Uplift Pull Test Procedure, by means comprising one or more U-shaped clamps dimensioned to fit snugly over the edges of the ICP.

16. The ICP of claim 1, wherein the prefabricated assembly is installed on top of a roof deck, such that:

the lower rigid cover board is adhered to the roof deck without using mechanical fasteners; and an upper surface of the upper rigid cover board is adhered to a roofing membrane.

17. The ICP of claim 16 wherein the ICP is preassembled in a facility that is remote from sites where the ICP is to be installed.

18. An insulating building roof based on vacuum insulation panel (VIP) roofing insulation, the insulating roof comprising:

a plurality of insulating composite panels (ICPs) that are adhered to a top surface of a deck of the roof, and are adhered to a bottom surface of a roofing membrane; wherein each ICP was pre-assembled in a facility that is remote from the building roof, and comprises:

a prefabricated assembly having a mass per unit area less than 3.0 pounds per square foot (14.7 kg/m$^2$), a thickness less than 2.0 inches (51 mm), and an initial thermal resistance (R value) greater than about 50° F.·ft$^2$·h/Btu (8.8 K·m$^2$/W), wherein the prefabricated assembly includes:

a vacuum insulation panel (VIP) comprising:

a) a substantially evacuated and hermetically sealed enclosure with walls made of a high gas barrier material in an approximately rectangular prismatic shape with low thickness/width and thickness/length ratios, and b) an internal rigid or semi-rigid core for keeping enclosure walls from collapsing while evacuated;

a lower rigid cover board adhered to a lower surface of the VIP, and an upper rigid cover board adhered to an upper surface of the VIP.

19. The ICP of claim 15, wherein the prefabricated assembly is installed on top of a roof deck, such that:

the lower rigid cover board is adhered to the roof deck without using mechanical fasteners; and an upper surface of the upper rigid cover board is adhered to a roofing membrane.

* * * * *